US008528453B2

(12) United States Patent
Hamann et al.

(10) Patent No.: US 8,528,453 B2
(45) Date of Patent: Sep. 10, 2013

(54) WATER JET CUTTING DEVICE WITH IMPROVED PART-HOLDING DEVICE

(75) Inventors: Jean-Christophe Hamann, La Baule (FR); Franck Guinchard, Pontchateau (FR)

(73) Assignee: Airbus Operations SAS (FR)

( * ) Notice: Subject to any disclaimer, the term of this patent is extended or adjusted under 35 U.S.C. 154(b) by 524 days.

(21) Appl. No.: 12/809,409

(22) PCT Filed: Dec. 17, 2008

(86) PCT No.: PCT/FR2008/052337

§ 371 (c)(1),
(2), (4) Date: Sep. 23, 2010

(87) PCT Pub. No.: WO2009/081037

PCT Pub. Date: Jul. 2, 2009

(65) Prior Publication Data

US 2011/0005361 A1 Jan. 13, 2011

(30) Foreign Application Priority Data

Dec. 20, 2007 (FR) ..... 07 60158

(51) Int. Cl.
*B26F 3/00* (2006.01)

(52) U.S. Cl.
USPC ..... 83/177; 83/375

(58) Field of Classification Search
USPC ..... 83/53, 402, 177, 375
See application file for complete search history.

(56) References Cited

U.S. PATENT DOCUMENTS

| | | | | |
|---|---|---|---|---|
| 2,994,314 | A * | 8/1961 | Wayland et al. | 125/21 |
| 4,116,097 | A | 9/1978 | Graham et al. | |
| 4,672,172 | A * | 6/1987 | Pearl | 219/121.67 |
| 5,927,320 | A * | 7/1999 | Pfarr et al. | 137/338 |
| 2005/0178257 | A1 * | 8/2005 | Lisec | 83/177 |
| 2008/0110312 | A1 * | 5/2008 | Knaupp et al. | 83/177 |
| 2010/0064870 | A1 * | 3/2010 | Olsen | 83/177 |

FOREIGN PATENT DOCUMENTS

| | | | |
|---|---|---|---|
| CN | 101045287 | A | 10/2007 |
| GB | 1191154 | A | 5/1970 |
| JP | 2005230994 | A | 9/2005 |

OTHER PUBLICATIONS

International Search Report dated Jul. 17, 2009.

* cited by examiner

*Primary Examiner* — Sean Michalski
(74) *Attorney, Agent, or Firm* — Lerner, David, Littenberg, Krumholz & Mentlik, LLP

(57) ABSTRACT

High-pressure water jet cutting techniques generate numerous handling problems both for the plates being cut and for cut parts. These problems can be resolved by the device according to the disclosed embodiments. This device includes a plurality of wires held under stress at a predetermined stress level above a plate being cut. These wires intercept a jet cutting the plate. This interception results in the creation of a micro-fastener holding the cut part to the plate. This micro-fastener can be easily broken. The plurality of wires also prevents the boiling effect of water in a cutting pool, this boiling resulting from the impact of the water jet in the pool.

9 Claims, 2 Drawing Sheets

WATER JET CUTTING DEVICE WITH IMPROVED PART-HOLDING DEVICE

CROSS-REFERENCE TO RELATED APPLICATIONS

This application is the National Stage of International Application No. PCT/FR2008/052337 International Filing Date, 17 Dec. 2008, which designated the United States of America, and which International Application was published under PCT Article 21 (s) as WO Publication No. WO2009/081037 A2 and which claims priority from, and the benefit of, French Application No. 200760158 filed on 20 Dec. 2007, the disclosures of which are incorporated herein by reference in their entireties.

The aspects of the disclosed embodiments relate to a water jet cutting device with an improved part-holding device.

The aspects of the disclosed embodiments relate to the field of material cutting and in particular to composite materials. In more detail, the aspects of the disclosed embodiments relate to the field of material cutting using a high pressure jet.

BACKGROUND

Abrasive water jet cutting is a known method and applied for cutting numerous materials including composite materials.

The principle of this cutting method is recalled hereinafter. A mobile cutting head is fitted with a nozzle by which a water jet is ejected with a very small diameter (0.1 to 0.5 mm), at a very high speed, and mixed with abrasive particles. This type of jet is capable of cutting through any type of material. The nozzle is located a few millimetres above the part to be cut. By moving the head, the water jet cuts the parts to the desired shape. The plate being cut is generally placed on a grating above a pool, whose purpose is to absorb the jet as soon as it has crossed through the part and to reduce noise levels.

In the prior art, when the jet reaches the pool after having crossed through the part, a significant level of boiling is produced. If the plate being cut is light, for example if it is comprised from composite material with a low thickness, this boiling can raise the cut parts that float and become blocked between the jet and the plate remaining to be cut.

In other examples, when cutting very thin parts, the stress relief within the material being cut can lead to a plate "rolling around itself" phenomenon, which can also cause collisions with the nozzle.

In order to avoid this type of collision, a simple solution consists in sufficiently spacing the parts in such a way that even if they become raised, they cannot come into contact with the nozzle. Typically, on planar cutting machines capable of cutting plates measuring 3 $m^2$ to create a range of complex parts, a minimum distance of 20 to 40 mm between the parts is sufficient to eliminate almost any risk of collision. The disadvantage of this principle is that the nesting compactness of the parts becomes degraded, which creates a particular problem for high cost materials such as aeronautic plates made out of composite materials. With this type of spacing, the compactness (surface area of the part/surface area of the whole plate) scarcely exceeds 60%.

In the prior art, solutions are known to correct this problem, however none of these solutions provide a truly satisfactory result. The following make up part of these known solutions:

A first solution consists in covering the plate being cut with another, heavier and generally thicker plate. This other plate thus limits the possibility of cut parts floating. However, in addition to the fact that this other plate leads to the consumption of "martyr plates", this solution reduces the quality and precision of the cut. Indeed, the jet is thus located further away from the parts being cut. As this jet is divergent and loses its coherence after a relatively short distance, this spacing of the jet creates a variation in dimension and an undercut edge shape. This solution therefore reduces the precision of the cut and the quality of the cut parts.

Other solutions exist based on vacuum systems using, for example, air vents positioned on the grating to hold the cut parts. This type of device is difficult to implement for plates with large dimensions (several $m^2$) in which a range of small parts are cut. Indeed, the jet must not deteriorate the holding devices. The position of the latter must therefore be taken into account in the cutting programme. This restriction reduces the nesting compactness and makes the implementation operation difficult if said nesting operations are performed "with the flow" within the scope of a stressed flow production.

Another solution is given by JP2005230994, which describes a water jet cutting method for semi-conductors aimed at producing electronic chips, i.e. parts with very small dimensions. In this embodiment, a double-sided polyethylene adhesive film is bonded underneath the plate being cut. On the other side, it touches a mesh comprised of "piano wire" with a diameter of between 0.1 and 0.5 mm. Then, a single-sided polyethylene adhesive film is bonded to the mesh and to the first film. The two films thus assembled with the internal mesh are placed under the substrate during the cutting operation. In jet cutting methods, the upper side is considered as the side exposed to the water jet. During the cutting operation, the jet crosses through the plate, thus cutting the latter into small squares. However, in this implementation, the jet does not manage to cut the piano wires, in particular as it has lost energy when crossing through the plate. Thus, the cut elements remain connected to each other via the adhesive from the parts of the film connected to the mesh that has not been cut, and can therefore be easily recovered. Such a device is difficult to transpose onto parts with large dimensions, taking into account the preparation time required in addition to the fact that the thickness of the parts concerned by the disclosed embodiments is insufficient in reducing the power of the jet in a significant manner.

Another solution, applied in other technologies for cutting a range of parts on the same plate consists in leaving fasteners or "small bridges" between the cut parts. These fasteners are themselves cut or broken by various means after the cutting process. The advantage of such a solution is that it enables the entire plate to preserve a certain level of mechanical cohesion. This enables the plate to be easily handled, in particular with regards to removing all of the cut parts from the cutting machine table in a single manoeuvre. This is particularly advantageous if this operation is to be automated. The notion of preserving this cohesion of the original plate is also efficient in limiting the deformations connected to stress relief.

However, this technique has major disadvantages when applied within the scope of a water jet cutting technology, and more particularly when involving the cutting of parts made out of composite materials. A cutting operation cannot be stopped and subsequently restarted, because the water jet cutting operation is created by two simultaneous effects:

- The high pressure of the water (which creates a high speed jet output)
- The presence of an abrasive within the jet.

Without an abrasive, the high performance composite materials cannot be cut. Moreover, the application of a very high pressure water jet without abrasive to the surface of a composite material of this type produces a significant level of delamination around the jet impact area.

The abrasive is mixed with the jet via a venturi device which sucks the abrasive thanks to a vacuum created by passing the jet at a high speed in a "barrel".

The jet cut off method is therefore as follows:

abrasive feed cut off progressive decrease in pressure (800 bars)

jet cut off

The reactivation of the cutting jet uses the reverse method:

start-up at low pressure (800 bars)

progressive increase in pressure (up to 2,500-3,000 bars)

abrasive feed.

Even if the progressive increases and decreases in pressure occur over short periods of time lasting approximately one second, the interaction of the high pressure jet without abrasive with the material presents a certain risk of causing delamination. This is why; in particular, all of the water jet's first contacts with the material generally occur outside of the areas of the parts, in areas making up the "skeleton" of the range of parts, which is later thrown away. Moreover, the cutting speed is approximately equal to 4 to 6 m/min according to the machines, types of materials cut and their thickness. During a "cutting/reactivation" cycle at this speed, the cutting head travels 8 to 10 mm, which involves a large area and creates a "large fastener". The cutting can be moved to the skeleton on either side of the fasteners. This therefore significantly extends the cutting time. Another possibility includes boring areas on either side of said fasteners with a drill before the jet cutting process. This requires a drill head to be fixed onto the machine, in addition to substantially extending the cutting time.

However, in all of these examples, the characteristics of the materials are such that the fasteners thus left must be sawn and filed down: they cannot be broken as the fastener, remaining relatively resistant, could cause delamination within the parts. The range of parts must therefore be processed manually, which reduces the level of productivity of these operations for cutting a range of parts.

These solutions from the prior art are not without disadvantages, in particular due to wasting materials by increasing the surface area of discarded products and increasing the cutting time for a plate.

SUMMARY

The disclosed embodiments resolve these problems by placing a plurality of stressed wires, parallel to each other, above a plate being cut. These wires are located between the nozzle outlet emitting the water jet and the plate being cut. These wires are stressed so as to:

enable the plate being cut and the cut parts to be held during the cutting process;

avoid the wires being cut by the jet as they can be moved during impact with the water jet;

limit the penetration of the water jet into the plate being cut under the wire, which produces a micro-fastener between the cut part and the plate being cut.

The wires therefore have two effects. On the one hand, they hold the plate. On the other hand, they enable the production of micro-fasteners, which preserve the connection of the cut parts between each other and with the plate discard parts. These micro-fasteners being reduced in size, and in particular with a thickness of less than the plate being cut, can be easily divided manually and without the risk of delaminating the cut parts.

The disclosed embodiments therefore relate to a water jet cutting device comprising a holding device for a plate made out of a material to be cut, wherein the holding device comprises:

a grating to support the plate being cut, a plurality of stressed wires positioned parallel to each other and held above the plate being cut and below a nozzle producing the water jet.

According to one preferred mode of embodiment of the disclosed embodiments, the wires are stressed along a single direction.

According to one preferred mode of embodiment of the disclosed embodiments, the stressing of the wires enables the water jet to move these wires.

According to one preferred mode of embodiment of the disclosed embodiments, the stressing of the wires is such that, for a stress of 10 newtons applied to the middle of the wire, a deflection of 20 mm is created.

According to one preferred mode of embodiment of the disclosed embodiments, the wires are made out of steel. Preferably, the steel used is included in the group of elements below:

mild steel, austenitic stainless steel.

According to one preferred mode of embodiment of the disclosed embodiments, the wires have a diameter of between 0.8 and 1.5 mm.

According to one preferred mode of embodiment of the disclosed embodiments, one end of a wire is attached to an unwinding device, the other end being attached to a stress tensor device.

According to one preferred mode of embodiment of the disclosed embodiments, the distance between two neighbouring wires is determined according to the average dimension of the parts being cut.

BRIEF DESCRIPTION OF THE DRAWINGS

The disclosed embodiments will be better understood after reading the following description and after examining the accompanying figures. These are presented as a rough guide and in no way as a limited guide to the disclosed embodiments. The figures show.

DETAILED DESCRIPTION

Figure 1:
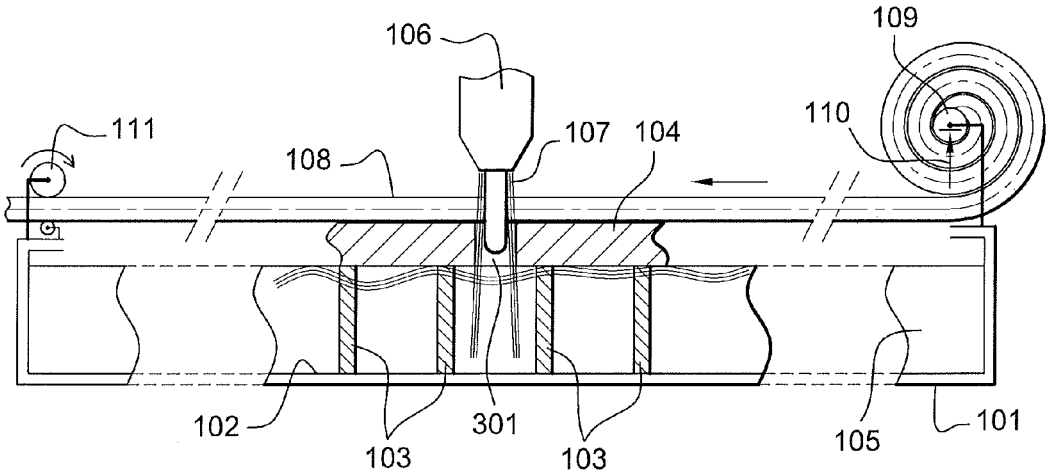
FIG. 1: a lateral view of a device according to the disclosed embodiments.

FIG. 1 shows a tank 101 on the bottom 102 of which is placed a grating 103 with a height of less than the depth of the tank. The grating 103 is formed from at least one plurality of vertical pins with tips defining a plane on which is placed a plate 104 to be cut. Tank 101 is filled with a liquid 105, for example water.

FIG. 1 also shows a nozzle 106, the end of a high pressure water projection device according to a jet 107. The jet 107 comprises, as previously described, water and an abrasive element.

Tank 101 is filled with a liquid, for example water, which serves to absorb the jet and reduce noise levels caused by its impact against an obstacle. Tank 101 is also known as the pool. Tank 101 is filled with liquid 105 to a level slightly lower than the height of the grating 103.

Plate 104 is cut by the movement of the jet 107 above the plate 104. This movement outlines a range of parts that must be produced from the plate 104.

FIG. 1 shows a wire 108 stressed on either side of the edges of tank 101. In practice there is a plurality of wires stressed in the same direction as wire 108. The wires can be stressed manually between two stops. In one preferred mode of embodiment, the wires are unwound and stressed by a stress tensor device. This stress tensor device comprises an unwinding device 109 comprising a coil and a brake 110. This stress tensor device also comprises control electronics which enable the unwinding device to be blocked when the required length of wire has been unwound. The unwinding device 109 is attached to one of the edges of tank 101. At the opposite end to unwinding device 109, attached to the edge of tank 101, the device according to the disclosed embodiments comprises a traction device 111 for wire 108. Device 111 comprises means for pulling wire 108 so as to unwind it from the unwinding device 109. Device 111 comprises for example two rotating rollers of which at least one is motor-driven, these two rollers pinching the wire 108 so as to unwind it. The motor is therefore driven by the same control logic as brake 110. The combined actions of the motor and the brake enable the level of stress of the wire 108 to be controlled.

Preferably, there is the same number of unwinding devices 109-111 as wires stressed above the plate 104. The motor can, in this example, be shared between several unwinding devices.

The wires are preferably made out of steel. In one mode of embodiment of the disclosed embodiments, they are comprised from mild steel or austenitic stainless steel. The diameter of the wires is comprised in the interval defined by the following values: 0.8 mm to 1.5 mm. This diameter depends on the thickness of the plate being cut, FIG. 1 also shows that wire 108 is stressed at a height located between the nozzle 106 and the plate 104, in such a way as to intercept the jet 107 when the nozzle 106 passes over the wire 108. All of the wires are stressed at the same height in relation to the plate 104. The effects from this interception will be described later.

Figure 2:
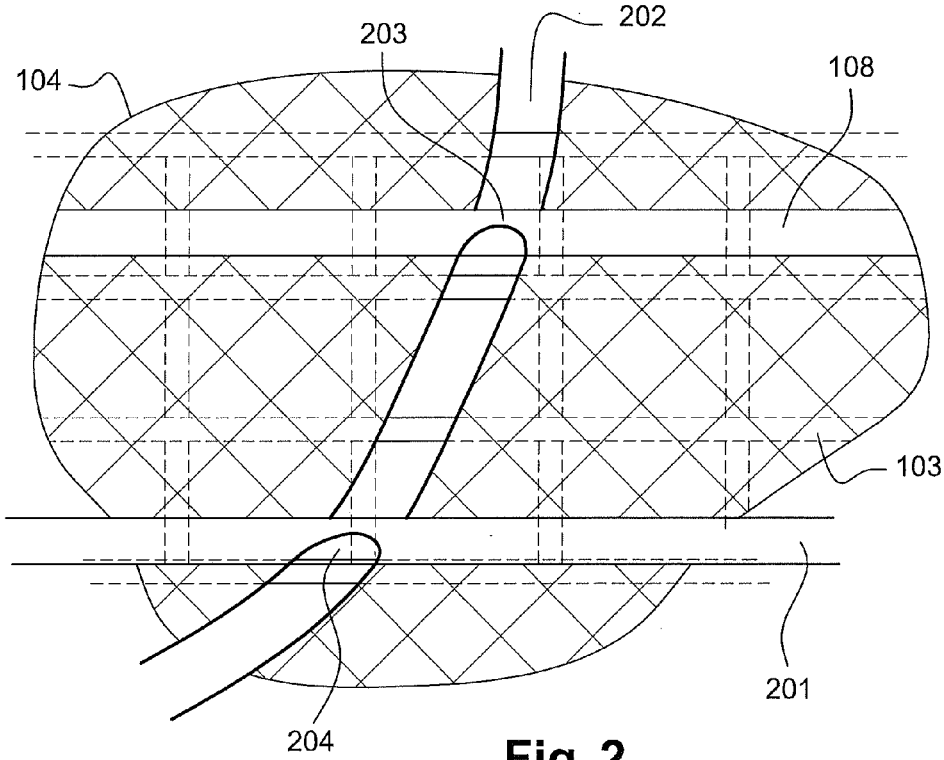
FIG. 2: a view of the device according to the disclosed embodiments from a plane parallel to the wires and located between the wires and the nozzle producing the water jet.

FIG. 2 shows the plate 104 placed on the grating 103 from an overhead view. FIG. 2 also shows wire 108 in addition to another wire 201. Wires 108 and 201 make up part of a plurality of wires stressed above the entire surface of the plate that the nozzle 106 is capable of exploring. The wires from the plurality of wires are all stressed along the same direction, at the same height and have identical mechanical characteristics and are stressed to the same level. In one mode of embodiment of the disclosed embodiments, this stressing is such that, for a stress of 10 newtons applied to the middle of the wire, this stress produces a deflection of 20 mm on the wire.

The wires from the plurality of wires are separated from each other at a distance corresponding to an average dimension of the parts being cut. In other words, the distance between two wires is slightly less than the largest dimension of the smallest part being cut.

The number of wires from the plurality depends on the dimensions of the work surface area of jet 107. In more detail, the number of wires from the plurality of wires depends on the distance that the nozzle 106 can travel perpendicular to the direction in which the threads are stressed.

In one mode of embodiment of the disclosed embodiments, this distance is standardised and falls within an interval of 5 cm to 50 cm.

FIG. 2 also shows a cut 202 performed in the plate 104 by the passage of jet 107. FIG. 2 additionally shows that wires 108 and 201 have been attacked by jet 107, which has left impressions 203 and 204 in wires 108 and 201. These impressions correspond to the stripping of material due to the action from jet 107. However, the wires from the plurality of wires have not been severed.

Thus, when the jet travels over wire 108, the wire tends to move away from the jet. The wire therefore begins to vibrate in the plane of the plate, according to a relatively low frequency (several Hertz) around its position of equilibrium.

Under these circumstances, although damaged, the wire is not cut by the water jet and a residual section remains which enables, on the one hand, the stress of the wire to be preserved and the parts to be held, and on the other hand, after the cutting operation, the wire to be rewound or a length of new wire to be unwound for cutting another plate.

This movement of wire 108 under the action from the water jet acts locally as a deflector and leads to an incomplete cut of the portion of material located underneath the wire 108, creating a micro-fastener between the opposite walls of the cut 202.

Figure 3:
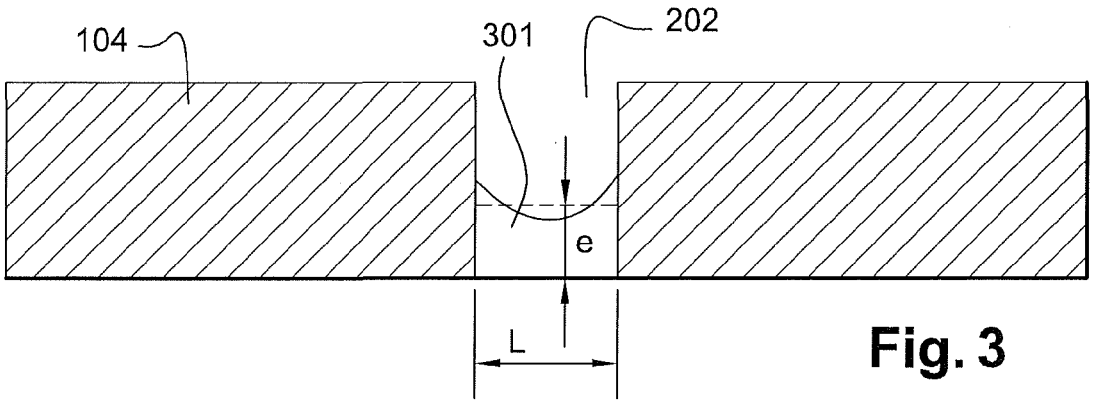
FIG. 3: a lateral view of a cut plate at the level of a micro-fastener.

FIG. 3 shows a local lateral view of the plate 104 at the level of the intersection of the cut 202 and wire 108. FIG. 3 shows a micro-fastener 301 connecting the two edges of the cut 202. This micro-fastener is located on the lower part of the plate 104. By means of the action from wire 108, the micro-fastener is thinner in its centre than at its edges attached to the plate 104. This characteristic eases the breaking of the micro-fastener while preventing any possible delamination of the cut part at the level of the micro-fastener.

A micro-fastener also has the following characteristics:

- a length L equal to the cutting width (diameter of the water jet) between 0.2 and 0.5 mm according to the characteristics of the jet;
- a width D equal to approximately the diameter of the wire, between approximately 0.6 and 1 times this diameter;
- and an average thickness e equal to approximately the thickness of the plate minus the diameter of the wire. If the wire has a diameter of 1 mm and the plate a thickness of 2.5 mm, the thickness of the micro-fastener will be approximately equal to 1.5 mm.

Figure 4:
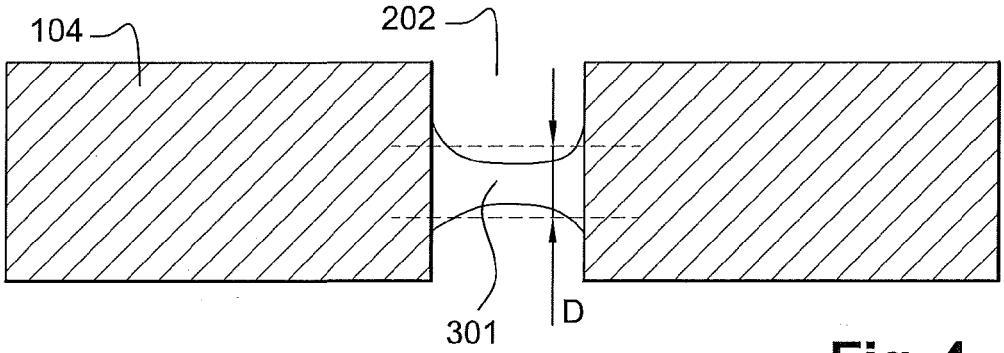
FIG. 4: an overhead view of a cut plate at the level of a micro-fastener.

FIG. 4 is a local overhead view of the plate 104 at the same level as for FIG. 3. FIG. 4 illustrates the characteristics previously described for the micro-fastener 301.

With the device according to the disclosed embodiments, a clean cut can thus be guaranteed and the plates being cut, parts cut and discard parts can be easily handled.

Indeed, after a cutting cycle, the parts remain attached to the discard parts, which maintains mechanical coherence between these parts and enables then to be handled as a single, whole plate. The cut plate, thus comprised from discard parts and cut parts, can therefore be easily replaced with a new plate to be cut. The separation of the discard parts from the cut parts can thus be performed when a new cutting cycle has been started.

The invention claimed is:

1. A water jet cutting device comprising a holding device for a plate made out of a material to be cut, wherein the holding device comprises:

- a grating to support the plate being cut,
- a plurality of stressed wires positioned parallel to each other and held above the plate being cut and below a nozzle producing the water jet.

2. A device according to claim 1, wherein the wires are stressed along a single direction.

3. A device according to claim 1, wherein the stressing of the wires enables the water jet to move these wires.

4. A device according to claim 1, wherein the stressing of the wires is such that, for a stress of 10 newtons applied to the middle of the wire, a deflection of 20 mm is created.

5. A device according to claim 1, wherein the wires are made out of steel.

6. A device according to claim 5, wherein the steel used is included in the group of elements below:

mild steel, austenitic stainless steel.

7. A device according to claim 1, wherein the wires have a diameter of 0.8 to 1.5 mm.

8. A device according to claim 1, wherein one end of a wire is attached to an unwinding device, the other end being attached to a stress tensor device.

9. A device according to claim 1, wherein a distance between two wires is slightly less than the largest dimension of the smallest part being cut.

* * * * *